US009951906B2

(12) United States Patent
Kempes et al.

(10) Patent No.: US 9,951,906 B2
(45) Date of Patent: Apr. 24, 2018

(54) APPARATUS AND METHOD FOR HEATING A LIQUEFIED STREAM

(71) Applicant: SHELL OIL COMPANY, Houston, TX (US)

(72) Inventors: Roderick Kempes, Calgary (CA); Robert Lansink, Rotterdam (NL); Gregory Martin Parry Perkins, Brisbane (AU); Leendert Johannes Arie Zoetemeijer, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 271 days.

(21) Appl. No.: 14/405,752

(22) PCT Filed: Jun. 12, 2013

(86) PCT No.: PCT/EP2013/062183
§ 371 (c)(1),
(2) Date: Dec. 4, 2014

(87) PCT Pub. No.: WO2013/186277
PCT Pub. Date: Dec. 19, 2013

(65) Prior Publication Data

US 2015/0121904 A1 May 7, 2015

(30) Foreign Application Priority Data

Jun. 12, 2012 (EP) ..... 12171677

(51) Int. Cl.
*F28D 15/02* (2006.01)
*F17C 9/02* (2006.01)
(Continued)

(52) U.S. Cl.
CPC ..... *F17C 9/02* (2013.01); *F28D 1/05316* (2013.01); *F28D 7/06* (2013.01); *F28D 15/0266* (2013.01);
(Continued)

(58) Field of Classification Search
CPC ..... F28D 15/0266; F28D 15/02; F17C 9/02; F17C 7/00; F17C 2265/05;
(Continued)

(56) References Cited

U.S. PATENT DOCUMENTS 1,959,377 A * 5/1934 Lucke ..... F22B 1/06 126/378.1
2,119,091 A 11/1935 Atkinson et al.
(Continued)

FOREIGN PATENT DOCUMENTS

CN 1090915 8/1994
CN 1151791 A 6/1997
(Continued)

OTHER PUBLICATIONS

Muramatsu, Jiro, JP01307600ATrans (English Translation), Dec. 1989.*
(Continued)

*Primary Examiner* — Len Tran
*Assistant Examiner* — Eric Ruppert

(57) ABSTRACT

In a heater for a liquefied stream, a first heat transfer zone has a box stretching longitudinally along an axis. A first heat transfer surface is arranged inside the box, across which a first indirect heat exchanging contact is established between a liquefied stream that is to be heated and a heat transfer fluid. A second heat transfer zone is located gravitationally lower and includes a second heat transfer surface across which the heat transfer fluid is brought in a second indirect heat exchanging contact with the ambient. A downcomer
(Continued)

fluidly connects the first heat transfer zone with the second heat transfer zone and has a first transverse portion and a first downward portion that are fluidly connected to each other via a connecting elbow portion. The connecting elbow portion, when viewed in a vertical projection on a horizontal plane, is located external to the box compared to the axis.

15 Claims, 3 Drawing Sheets

(51) Int. Cl.

| | |
|---|---|
| ***F28D 1/053*** | (2006.01) |
| ***F28D 7/06*** | (2006.01) |
| *F28F 1/24* | (2006.01) |
| *F28D 21/00* | (2006.01) |

(52) U.S. Cl.
CPC .... *F28D 15/0275* (2013.01); *F17C 2221/033* (2013.01); *F17C 2223/013* (2013.01); *F17C 2227/0323* (2013.01); *F28D 2021/0066* (2013.01); *F28F 1/24* (2013.01)

(58) Field of Classification Search
CPC ..... F17C 2227/0393; F17C 2227/0309; F17C 2227/03234
USPC ..... 165/104.14, 104.21; 62/50.2
See application file for complete search history.

(56) References Cited

U.S. PATENT DOCUMENTS

| | | | |
|---|---|---|---|
| 2,273,257 | A | 2/1942 | Gardner |
| 2,350,348 | A | 12/1942 | Gaugler |
| 2,499,736 | A | 3/1950 | Kleen |
| 2,562,739 | A | 7/1951 | Marten |
| 2,580,547 | A | 1/1952 | Hollcroft |
| 2,837,212 | A | 6/1958 | Schmid |
| 3,229,759 | A | 1/1966 | Grover |
| 3,469,698 | A | 9/1969 | Blendermann |
| 3,887,759 | A | 6/1975 | Staub et al. |
| 4,027,728 | A | 6/1977 | Kobayashi et al. |
| 4,046,157 | A | 9/1977 | Cazalaa et al. |
| 4,194,536 | A | 3/1980 | Stine et al. |
| 4,237,866 | A | 12/1980 | Rush |
| 4,343,156 | A | 8/1982 | Gauthier |
| 4,431,546 | A | 2/1984 | Hughes et al. |
| 4,485,670 | A | 12/1984 | Camarda et al. |
| 4,798,914 | A | 1/1989 | Link et al. |
| 4,995,234 | A | 2/1991 | Kooy et al. |
| 5,195,575 | A | 3/1993 | Wylie |
| 5,360,056 | A | 11/1994 | Forsberg |
| 5,803,161 | A | 9/1998 | Wahle et al. |
| 5,931,156 | A | 8/1999 | Wang et al. |
| 6,026,889 | A | 2/2000 | Pase |
| D425,013 | S | 5/2000 | Lai |
| 6,119,767 | A | 9/2000 | Kadota et al. |
| 2003/0019219 | A1 | 1/2003 | Viegas et al. |
| 2004/0028578 | A1 | 2/2004 | Zardi |
| 2005/0261530 | A1 | 11/2005 | Stell et al. |
| 2005/0274126 | A1 | 12/2005 | Baudat |
| 2006/0242969 | A1 | 11/2006 | Minton et al. |
| 2007/0102138 | A1 | 5/2007 | Kadota et al. |
| 2008/0156034 | A1 | 7/2008 | Cur et al. |
| 2010/0000233 | A1 | 1/2010 | Groothuis et al. |
| 2012/0118545 | A1 | 5/2012 | Ayub et al. |
| 2013/0025832 | A1 | 1/2013 | Yang |

FOREIGN PATENT DOCUMENTS

| | | | | |
|---|---|---|---|---|
| CN | 1157577 | A | | 8/1997 |
| CN | 1167249 | A | | 12/1997 |
| CN | 2383027 | Y | | 6/2000 |
| CN | 1957066 | A | | 5/2007 |
| CN | 101182976 | A | | 5/2008 |
| CN | 201069316 | Y | | 6/2008 |
| CN | 101495795 | A | | 7/2009 |
| DE | 4431546 | | | 3/1996 |
| EP | 35444 | | | 6/1981 |
| EP | 450906 | | | 2/1991 |
| EP | 550845 | | | 10/1992 |
| EP | 604982 | | | 12/1993 |
| EP | 0757385 | A2 | | 2/1997 |
| EP | 915311 | | | 5/1998 |
| EP | 1855047 | A1 | | 11/2007 |
| GB | 181647 | | | 10/1921 |
| GB | 1416106 | A | | 12/1975 |
| JP | 54057222 | | | 8/1979 |
| JP | 55101710 | | | 8/1980 |
| JP | 55165494 | | * | 12/1980 |
| JP | 56-24036 | | | 3/1981 |
| JP | S62131199 | A | | 6/1987 |
| JP | S62233687 | A | | 10/1987 |
| JP | 63076652 | | | 5/1988 |
| JP | H01111197 | A | | 4/1989 |
| JP | 180100 | | | 12/1989 |
| JP | 01307600 | A | * | 12/1989 |
| JP | 03286991 | | | 12/1991 |
| JP | 2001200995 | | | 7/2001 |
| WO | 2006002030 | | | 1/2006 |

OTHER PUBLICATIONS

Fujishima, JP55165494Trans (English Translation), Dec. 1980.*
PCT International Search Report, Application No. PCT/EP2013/062183 dated Jul. 10, 2013.
MSDS R744; BOC Gases; Dec. 13, 2005.
R744; The Linde Group; retreived from the Internet on Feb. 10, 2014.
Joseph H Cho et al "Applicabilities and Limitations of LNG Vaporization Processes", LNG Journal Jun. 2005, pp. 24-26.
GM Grover et al "Structures of Very High Termal Conductivity", J. Appl. Phys. vol. 35, staring p. 1990 (1964).
Amir Faghri, "Heat Pipe Science & Technology", Taylor and Francis, 1995; pp. 1-33 and 578-593.
Zhang et al., "Configuration analysis of a novel zero C02 emission cycle with LNG cryogenic exergy utilization", IMECE2003-41958, Proceedings of IMECE, Nov. 16-21, 2003.
De Souza et al., "An Experimental Investigation of a C02 Pulsating Heat Pipe", 14th International Heat Pipe Conference (14th IHPC), Florian6polis, Brazil, Apr. 22-27, 2007.
Zarling et al., "Thermosiphon-Based Designs and Applications for Foundations Built on Permafros", International Arctic Technology Conference, May 29-31, 1991, Anchorage, Alaska.
Worthington W.S., et al: "Improved Regasification Methods Reduce Emissions", Hydrocarbon Processing, Jul. 2005, pp. 51-54.
English Translation of Office Action issued by Japanese Patent Office dated Jun. 15, 2012, including select figures annotated with English text.

* cited by examiner

APPARATUS AND METHOD FOR HEATING A LIQUEFIED STREAM

CROSS-REFERENCE TO RELATED APPLICATIONS

The present application is a National Stage (§ 371) application of PCT/EP2013/062183, filed Jun. 12, 2013, which claims the benefit of European Application No. 12171677.3, filed Jun. 12, 2012, both of which are incorporated herein by reference in their entirety.

The present invention relates to an apparatus and a method for heating a liquefied stream.

A liquefied stream in the present context has a temperature below the temperature of the ambient. Preferably, the temperature of the liquefied stream is on or below the bubble point of the liquefied stream at a pressure of less than 2 bar absolute, such as to keep it in a liquid phase at such a pressure. An example of a liquefied stream in the industry that requires heating is liquefied natural gas (LNG).

Natural gas is a useful fuel source. However, it is often produced a relative large distance away from market. In such cases it may be desirable to liquefy natural gas in an LNG plant at or near the source of a natural gas stream. In the form of LNG natural gas can be stored and transported over long distances more readily than in gaseous form, because it occupies a smaller volume and does not need to be stored at high pressure.

LNG is generally revaporized before it is used as a fuel. In order to revaporize the LNG heat may added to the LNG. Before adding the heat, the LNG is often pressurized to meet customer requirements. Depending on gas grid specifications or requirements desired by a customer, the composition may also be changed if desired, for instance by adding a quantity of nitrogen and/or extracting some of the $C_2$-$C_4$ content. The revaporized natural gas product may then be sold to a customer, suitably via the gas grid.

Patent application publication US2010/0000233 describes an apparatus and method for vaporizing a liquefied stream. In this apparatus and method, a heat transfer fluid is cycled, in a closed circuit, between a first heat transfer zone wherein heat is transferred from the heat transfer fluid to the liquefied stream that is to be vaporized, and a second heat transfer zone wherein heat is transferred from ambient air to the heat transfer fluid. The heat transfer fluid is condensed in the first heat transfer zone and vaporized in the second heat transfer zone. The heat transfer fluid is cycled using gravitational force exerted on the heat transfer fluid being cycled in the closed circuit.

The US '233 publication also proposes that the closed circuit for the heat transfer fluid can form part of a support frame by which the first heat transfer zone is supported, whereby the closed circuit forms support legs defining an angle between them. However, the additional requirements incurred by the proposed additional use of the closed circuit as support frame may compromise or adversely affect the ability to effectively transfer heat from the ambient air to the heat transfer fluid in the second heat transfer zone.

In accordance with a first aspect of the present invention, there is provided an apparatus for heating a liquefied stream, comprising a closed circuit for cycling a heat transfer fluid, the closed circuit comprising a first heat transfer zone, a second heat transfer zone, and a downcomer, all arranged in an ambient, wherein the first heat transfer zone comprises a first box in the form of a shell that contains the heat transfer fluid, which first box stretches longitudinally along a main axis, wherein a first heat transfer surface is arranged inside the first box, across which first heat transfer surface a first indirect heat exchanging contact is established between a liquefied stream that is to be heated and the heat transfer fluid, wherein the second heat transfer zone is located gravitationally lower than the first heat transfer zone and where the second heat transfer zone comprises a second heat transfer surface across which the heat transfer fluid is brought in a second indirect heat exchanging contact with the ambient, and wherein the downcomer fluidly connects the first heat transfer zone with the second heat transfer zone, wherein the downcomer comprises a first transverse portion and a first downward portion that are fluidly connected to each other via a connecting elbow portion, wherein the connecting elbow portion when viewed in a vertical projection on a horizontal plane is located external to the first box compared to the main axis.

In accordance with a second aspect of the invention, there is provided a use of an apparatus provided in the first aspect of the invention, for instance in a method of heating a liquefied stream, which comprises:

- providing an apparatus according to the first aspect of the invention and in said apparatus:
- passing the liquefied stream that is to be heated through the first heat transfer zone in indirect heat exchanging contact with the heat transfer fluid whereby heat transfers from the heat transfer fluid to the liquefied stream, thereby condensing at least part of the heat transfer fluid to form a condensed portion;
- cycling the heat transfer fluid in the closed circuit from the first heat transfer zone via at least the downcomer to the second heat transfer zone and back to the first heat transfer zone, all arranged in the ambient, wherein said cycling of the heat transfer fluid comprises passing the condensed portion in liquid phase downward through the downcomer to the second heat transfer zone, and passing the heat transfer fluid through the second heat transfer zone to the first heat transfer zone, whereby in the second heat transfer zone indirectly heat exchanging with the ambient thereby passing heat from the ambient to the heat transfer fluid and vaporizing the heat transfer fluid.

The invention will be further illustrated hereinafter by way of example only and with reference to the non-limiting drawing in which.

Figure 1:
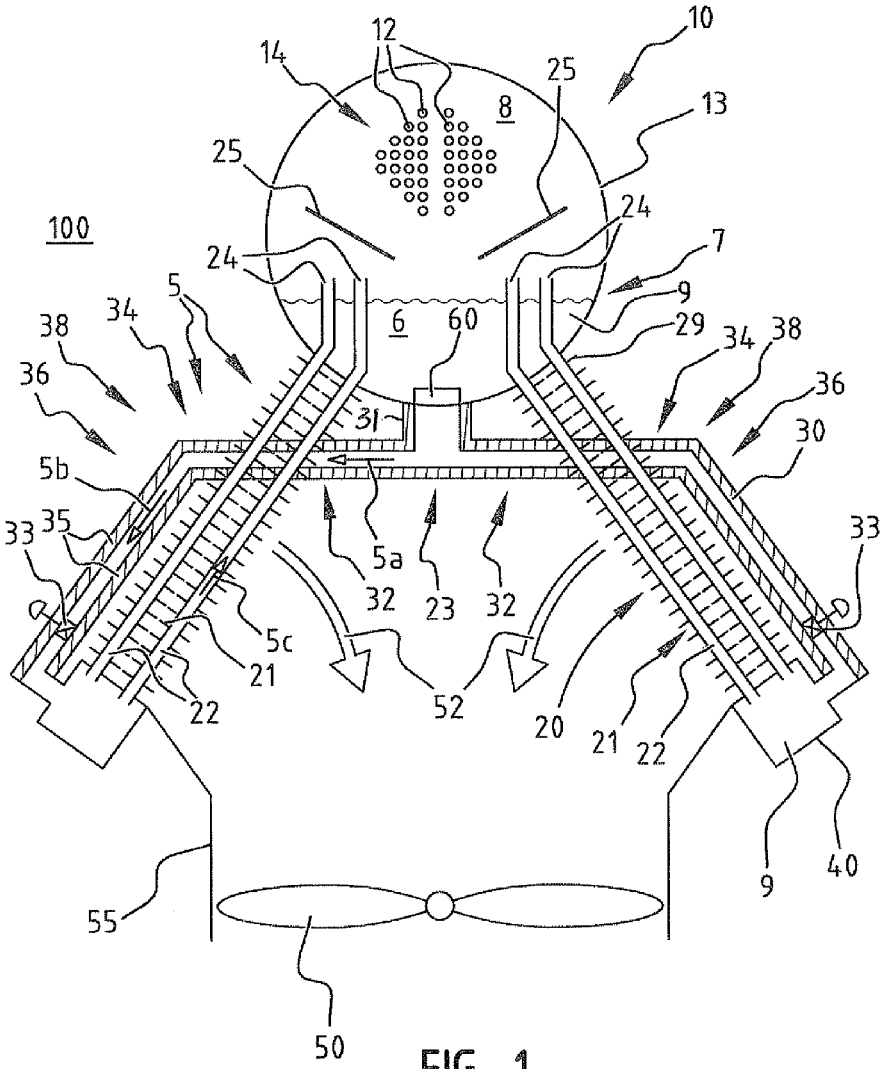
FIG. 1 represents a transverse cross section of a heater in which the invention is embodied.

For the purpose of this description, a single reference number will be assigned to a line as well as a stream carried in that line. Same reference numbers refer to similar components. The person skilled in the art will readily understand that, while the invention is illustrated making reference to one or more a specific combinations of features and measures, many of those features and measures are functionally independent from other features and measures such that they can be equally or similarly applied independently in other embodiments or combinations.

Described below is an apparatus for heating a liquefied stream. In the apparatus a first heat transfer zone comprises a first box in the form of a shell that contains the heat transfer fluid, which first box stretches longitudinally along a main axis, wherein a first heat transfer surface is arranged inside the first box. A second heat transfer zone is located gravitationally lower than the first heat transfer zone. A downcomer fluidly connects the first heat transfer zone with the second heat transfer zone.

The second heat transfer zone comprises a second heat transfer surface across which the heat transfer fluid is brought in a second indirect heat exchanging contact with the ambient. It is presently considered that the ability to effectively transfer heat from the ambient air to the heat transfer fluid in the second heat transfer zone may be influenced by the circulation of the heat transfer fluid through the closed circuit and/or the circulation of ambient air in the second heat transfer zone. Defects in either of these circulations may negatively impact the effectiveness of transferring heat from the ambient air to the heat transfer fluid. It would be beneficial to further improve the transfer of heat from the ambient air to the heat transfer fluid in the second heat transfer zone.

In the presently proposed apparatus for heating of the liquid, the downcomer is arranged to comprise a first transverse portion and a first downward portion. The first transverse portion and the first downward portion are fluidly connected to each other via a connecting elbow portion. The connecting elbow portion, when viewed in a vertical projection on a horizontal plane, is located external to the first box, while in this projection the main axis may be located within the first box. With such a configuration, it is achieved that the downward portion of the downcomer is (horizontally) displaced from the first box (when viewed in the described projection). Consequently, the circulation of ambient air in vertical direction may under find less hindrance by the first box in which the first heat transfer zone is housed, because the ambient air can circulate in a vertical direction between the connecting elbow and the first box.

Furthermore, due to the partitioning of the downcomer in a transverse portion and a downward portion, it is possible to avoid less desired angles of inclination of the nominal flow direction in the downcomer over a significant part of the length of the downcomer. This allows selecting a desired span in the support base independently from flow considerations of the heat transfer fluid through the downcomer.

The second heat transfer surface may be, at least for a part of the second heat transfer surface, arranged in the space between the connecting elbow and the first box when seen in the projection on the horizontal plane.

With the proposed modification of the heater, the closed circuit is more suitable for functioning as support frame, but it is expressly noted that the merits of the present invention also apply if the closed circuit is not employed as support frame. Accordingly, while such embodiments are preferred embodiments, the invention is not limited to embodiments wherein the closed circuit is used as a support frame.

Figure 3:
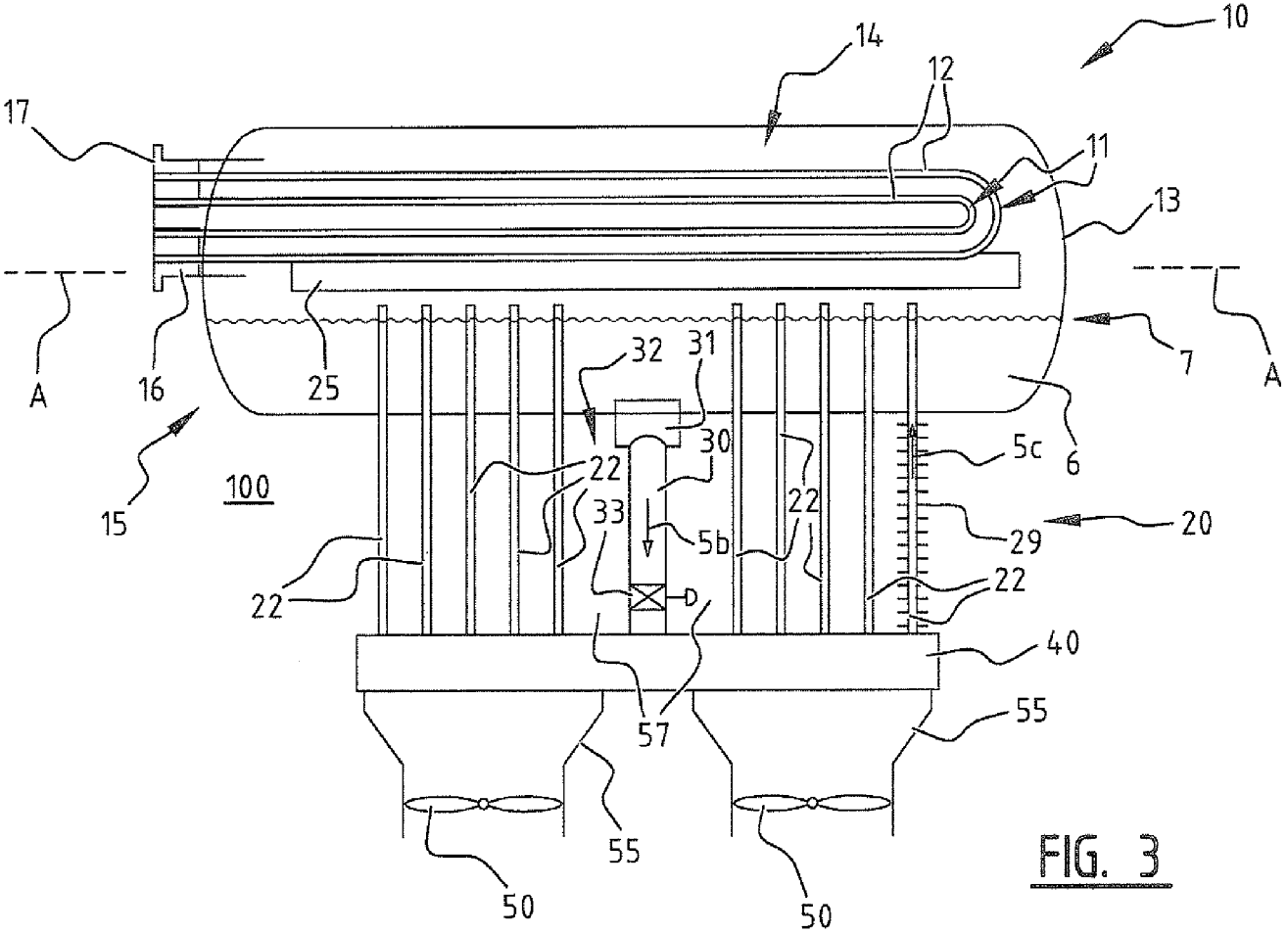
FIG. 3 represents a longitudinal section of the heaters of FIGS. 1 and 2.

One non-limiting example of an apparatus for heating a liquefied stream is shown in FIGS. 1 and 3, in the form of a heater of liquefied natural gas. This heater may also be used as a vaporizer of liquefied natural gas. FIG. 1 shows a transverse cross section, and FIG. 3 a longitudinal section of the apparatus.

The apparatus comprises a first heat transfer zone 10, a second heat transfer zone 20, a downcomer 30, and a closed circuit 5 for cycling (indicated by arrows 5*a*, 5*b*, 5*c*) a heat transfer fluid 9, all arranged in an ambient 100. Typically, the ambient 100 consists of air. The first heat transfer zone 10, the second heat transfer zone 20 and the downcomer 30 all form part of the closed circuit 5. The second heat transfer zone 20 may comprise at least one riser tube 22, in which case the heat transfer fluid 9 may be conveyed within the at least one riser tube 22 while the ambient is in contact with the outside of the at least one riser tube 22.

The first heat transfer zone 10 comprises a first box 13, in the form of a shell, which contains the heat transfer fluid 9. The first heat transfer zone 10 comprises a first heat transfer surface 11, which may be arranged within the first box 13. The shell of the first box 13 may be an elongated body, for instance in the form of an essentially cylindrical drum, provided with suitable covers on the front and rear ends. Outwardly curved shell covers may be a suitable option. The shell stretches longitudinally along a main axis A.

The first heat transfer surface 11 functions to bring a liquefied stream that is to be heated in a first indirect heat exchanging contact with the heat transfer fluid 9, whereby the heat transfer fluid 9 is located on the opposing side of the first heat exchange surface 11 which is the side of the first heat exchange surface that faces away from the liquefied stream that is to be heated.

The second heat transfer zone 20 is located gravitationally lower than the first heat transfer zone 10. The second heat transfer zone 20 comprises a second heat transfer surface 21, across which the heat transfer fluid 9 is brought in a second indirect heat exchanging contact with the ambient 100.

The downcomer 30 fluidly connects the first heat transfer zone 10 with the second heat transfer zone 20. The downcomer 30 has an upstream end for allowing passage of the heat transfer fluid from the first heat transfer zone 10 into the downcomer 30, and a downstream end for allowing passage of the heat transfer fluid 9 from the downcomer 30 towards the second heat transfer zone 20.

In more detail, the downcomer 30 has a transverse portion 34 and a downward portion 36 fluidly connected to each other via a connecting elbow portion 38. The connecting elbow portion 38, when viewed in a vertical projection on a horizontal plane, is located external to the first box 13 compared to the main axis A. The downward portion 36 of the downcomer 30 can be horizontally displaced (in the projection) from the first box 13. Consequently, the circulation of ambient air (52) in vertical direction needs to be hindered less by the first box 13 in which the first heat transfer zone 10 is housed, because the ambient air can circulate in a vertical direction between the connecting elbow 38 and the first box 13.

The second heat transfer 21 surface is preferably arranged, at least for a part of the second heat transfer surface 21, in the space between the connecting elbow 38 and the first box 13 when seen in the projection on the horizontal plane.

The downcomer 30 may take various forms. For instance, as non-limiting example, the downcomer may comprise a common section 31 which fluidly connects the first heat transfer zone 10 with a T-junction 23 where the heat transfer fluid 9 is divided over two branches 32.

A valve 33, for instance in the form of a butterfly valve, may optionally be provided in the downcomer 30 and/or in each of the branches 32 of the downcomer 30. This may be a manually operated valve. With this valve the circulation of the heat transfer fluid through the closed cycle can be trimmed; in case of a large vertical differential in the downcomer 30, there could be substantial effect of the liquid static head on the bubble point (boiling point) which can be counteracted by creating a frictional pressure drop through the valve 33.

In a group of embodiments, such as illustrated in FIG. 1, the downcomer 30 runs approximately parallel to the riser tube(s) 22 over the downward portion 36.

Figure 2:
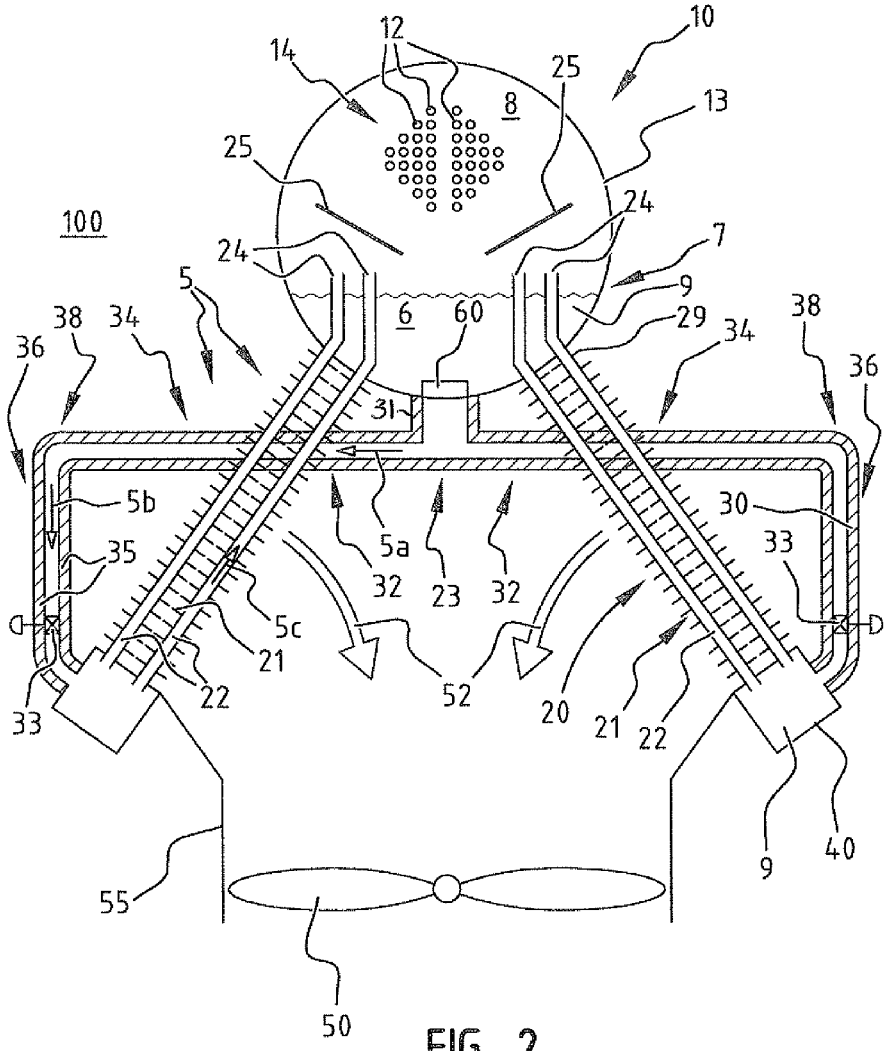
FIG. 2 represents a transverse cross section of a heater in which the invention is embodied.

However, in a group of alternative embodiments at least the downward portion 36 the downcomer 30 (or of each branch 32 in the downcomer 30) is positioned with a more vertical flow direction, for example deviating from the vertical direction by an angle of less than 30°. Referring now to FIG. 2, there is schematically shown a cross section similar to FIG. 1, of an example of such an alternative embodiment. The alternative embodiment has many of the same features as described above. One difference to be highlighted is that the flow direction along arrow 5*b* of the heat transfer fluid 9 in the downward portion 36 of each branch 32 deviates less from vertical than the flow direction along arrow 5*c* of the heat transfer fluid 9 in the generally straight portion of the riser tubes 22. Preferably, the flow direction along arrow 5*b* in the downward portion 36 of each branch 32 stretches within about 10° from vertical.

In the example as shown in FIG. 2, the second heat transfer surface 21 is arranged predominantly in the space between the connecting elbow 38 and the first box 13 (when seen in the projection on the horizontal plane).

A first nominal flow direction of the heat transfer fluid 9 from the first heat transfer zone 10 to the second heat transfer zone 20 in the transverse portion 34 (indicated by arrow 5*a*) may suitably be less vertically directed than a second nominal flow direction of the heat transfer fluid 9 from the first heat transfer zone 10 to the second heat transfer zone 20 in the downward portion 36 (the latter nominal flow direction is indicated by 5*b*). Preferably, the first nominal flow direction (5*a*) is deviated within a range of from 60° to 90° from the vertical direction, more preferably within a range of from 80° to 90° from the vertical direction. Preferably, the second nominal flow direction (5*b*) is deviated within a range of from 0° to 40° from the vertical direction, more preferably within a range of from 0° to 30° from the vertical direction, and most preferably within a range of from 0° to 10° from the vertical direction. Without intending to be limited by the theory, it has been found that pressure gradient in a downcomer portion that is orientated this way (i.e. vertical or near-vertical down flow) is less sensitive to vapour generation than when it is orientated at an angle of inclination between 10° and 60° from vertical. It is currently understood that the pressure gradient in the downcomer is particularly sensitive to presence of vapour within this inclination range, whereby the two-phase flow regime is stratified wavy. The sensitivity of the circulation of the heat exchange fluid 9 through the closed circuit to the presence of vapour in the downcomer is surprisingly sensitive at angles of inclination in the range of between 30° and 60°

By arranging the transverse portion 34 such that the first nominal flow direction (5*a*) is deviated within a range of from 60° to 90° from the vertical direction, preferably within a range of from 80° to 90° from the vertical direction, and arranging the downward portion 36 such that the second nominal flow direction (5*b*) is deviated within a range of from 0° to 40°, preferably within a range of from 0° to 30° from the vertical direction, more preferably within a range of from 0° to 10° from the vertical direction, an average flow direction through all portions of the downcomer 30 of within the inclination range of between 30° and 60° can be achieved without the need for the heat transfer fluid 9 to flow through the downcomer 30 at an angle within this inclination range except for a relatively small duration within the connecting elbow portion 38. In such embodiments, the connecting elbow portion 38 is defined as the part of the downcomer between the transverse portion 34 and the downward portion 36 where the flow direction is at an inclination between 30° and 60°.

The second heat transfer surface 21 may be located in a generally straight portion of the at least one riser tube 22. The heat transfer fluid 9 is cycled along a third nominal flow direction, along arrow 5*c*, in the generally straight portion of the riser tube 22. The third nominal flow direction (indicated at arrow 5*c*) of the heat transfer fluid 9 inside the generally straight portion may deviate from vertical by an inclination angle that is less than the amount of deviation from the vertical of the first nominal flow direction (5*a*) and that is more than the amount of deviation from the vertical of the second nominal flow direction (5*b*). For instance, the third nominal flow direction (5*c*) may deviate from vertical by an inclination angle of between 20° and 70°, preferably of between 30° and 60°.

The generally straight portion of the at least one riser tube 22 may be at any desired angle, including angles corresponding the third nominal flow direction (5*c*) as specified above. In one example, the heat transfer fluid 9 is cycled in the direction along arrow 5*c* in the generally straight portion of the riser tube 22 deviating by an angle of about 30° from vertical.

Optionally, in all embodiments and illustrated in FIGS. 1-3, the closed circuit 5 may comprise a distribution header 40 to fluidly connect the downcomer 30 and the second heat transfer zone 20 with each other. Such a distribution header 40 may be useful if the second heat transfer zone 20 comprises a plurality of riser tubes 22. The at least one riser tube 22, or plurality thereof, is fluidly connected to the first heat transfer zone 10. The optional distribution header 40 is preferably arranged gravitationally lower than the second heat transfer zone 40.

In embodiments wherein the downcomer 30 comprises two branches 32 as described above, the two branches 32 may be connected to one distribution header 40 each, whereby each of these distribution headers are separate in the sense that the heat transfer fluid 9 inside one of these distribution headers cannot flow to the other except via the T-junction 23 or via the first heat transfer zone 10. The T-junction 23 may be located gravitationally below the first box 13.

If the first box 13 is provided in the form of an elongated hull stretching along main axis A, the branches 32 may suitably extend transverse to the direction of the main axis A. The riser tubes 22 of the plurality of riser tubes may be arranged distributed over the distribution header 40 in a main direction that is parallel to the main axis A. In this case, each distribution header 40 suitably also has an elongate shape essentially in the same direction as the main axis A, in which case the riser tubes 22 may be suitably configured in a plane that is parallel to the main axis A. In a particularly advantageous embodiment, the riser tubes are arranged over a two-dimensional pattern both in the main direction as well as in a transverse direction extending transversely relative to the main direction. The invention also encompasses embodiments wherein the downward portion 36 of each branch of the downcomer 30 is arranged in the same plane as the riser tubes 22.

The number of riser tubes 22 that fluidly connect a selected distribution header 40 with the first heat transfer zone 10 is larger than the number of downcomers (and/or number of branches of a single downcomer) that fluidly connect the first heat transfer zone 10 with that same distribution header 40. For instance, in one example there are 84 riser tubes 22 arranged between the first heat transfer zone 10 and a single distribution header 40 which is supplied with the heat transfer fluid 9 by only a single branch 32 of a single downcomer 30. The plurality of riser tubes 22 may suitably be arranged divided in two subsets, a first subset being arranged on one side of the downcomer 30 (or branch 32) that connects the distribution header 40 with the first heat transfer zone 10, while a second subset of which is arranged on the other side of the downcomer 30 (or branch 32). An air seal 57 may be located between the downcomer 30 (or branch 32) and each of the subsets of riser tubes 22, on either side of the downcomer 30, to avoid that air bypasses the second heat transfer zone though the gap between the downcomer 30 and each of the subsets of riser tubes 22.

If the second heat transfer surface 21 comprises one or more riser tubes 22, the heat transfer fluid 9 may be conveyed within the one or more riser tubes 22 while the ambient is in contact with the outside of the one or more riser tubes 22. The outside surface of the one or more riser tubes 22 may conveniently be provided with heat transfer improvers such as area-enlargers. These may be in the form of fins 29, grooves (not shown) or other suitable means. Please note that fins 29 may be present on all of the riser tubes 22, but for reason of clarity they have only been drawn on one of the riser tubes 22 in FIG. 3.

Regardless how the second heat transfer zone 20 and/or the riser tubes 22 are configured, a fan 50 (one or multiple) may be positioned relative to the second heat transfer zone 20 to increase circulation of ambient air along the second heat transfer zone 20, as indicated in FIG. 1 by arrows 52. Herewith the heat transfer rate in the second indirect heat exchanging contact may be increased. Preferably the fan is housed in an air duct 55 arranged to guide the ambient air from the fan 20 to the second heat transfer zone 20 or vice versa. In a preferred embodiment, the ambient air circulates generally downwardly from the second heat transfer zone 20 into the air duct 55 and to the fan 50.

The first box 13 may contain a liquid layer 6 of the heat transfer fluid 9 in liquid phase, and a vapour zone 8 above it. A nominal liquid level 7 is defined as the level of the interface between liquid layer 6 and the vapour zone 8 during normal operation of the heater. The first heat exchange surface 11 is preferably arranged within the vapour zone 8 in the first heat transfer zone 10, above the nominal liquid level 7. Herewith the heat transfer in the first heat exchanging contact between the liquefied stream that is to be heated and the heat transfer fluid 9 can most effectively benefit from the heat of condensation of the heat transfer fluid 9 that is available within in the vapour zone 8.

The first heat transfer surface 11 may suitably be formed out of one or more tubes 12, optionally arranged in a tube bundle 14. In such a case, the liquefied stream that is to be heated may be conveyed within the one or more tubes 12 while the heat transfer fluid is in contact with the outside of the one or more tubes 12. Analogue to shell and tube heat exchangers, the tubes 12 may be arranged single pass or multi pass, with any suitable stationary head on the front end and/or rear end if necessary.

As one example, referring now mainly to FIG. 3, there is shown a two-pass tube bundle 14 in the form of a U-tube bundle. However, the invention is not limited to this type of bundle. The shell cover on the front end 15 of this particular shell is provided with a cover nozzle 16 comprising a head flange 17 to which any type of suitable, preferably stationary, head and tube sheet can be mounted. One or more pass partitions may be provided in the head for multi-pass tube bundles. Typically, a single pass partition suffices for a two-pass tube bundle. The invention is not limited to this particular type of cover nozzle 16; for instance a cover nozzle with a fixed tube sheet may be selected, instead. A suitable head is an integral bonnet head or a head with removable cover. The tubes may be secured in relative position with each other by one or more transverse baffles or support plates. A mechanical construction inside the first box 13 may be provided to support the tube bundle, for instance in the form of a structure that is positioned below the tube bundle. The tube ends may be secured in the tube sheet.

Optionally the rear end may also be provided with a cover nozzle, so that, instead of the U-tube, a tube sheet may be provided at the rear end as well.

The interface between the first heat transfer zone 10 and the downcomer 30 may be formed by a through opening in the shell of the first box 13. The interface is preferably located gravitationally lower than the nominal liquid level 7 of the heat transfer fluid 9 within the first box 13.

The second heat transfer zone 20 preferably discharges into the first heat transfer zone 10 at a location that is gravitationally above the nominal liquid level 7. This way the heat transfer fluid 9 can be cycled back from the second heat transfer zone 20 to the first heat transfer zone 10 while bypassing the layer of liquid phase of the heat exchange fluid 9 that has accumulated in the first box 13. This may be accomplished as illustrated in FIGS. 1 and 2 by riser end pieces 24 fluidly connected to the riser tubes and extending between the riser tubes 22 and a vapour zone 8 inside the first heat transfer zone 10 above the nominal liquid level 7, which riser end pieces 24 traverse the liquid layer 6.

The open ends of the riser end pieces 24 may be located gravitationally higher than the first heat exchange surface 11, or gravitationally lower than the first heat exchange surface 11. Optionally, especially in the latter case, one or more liquid diversion means may be provided to shield the riser end pieces 24 from condensed heat exchange fluid 9 falling down from the first heat exchange surface 11 during operation. Such liquid diversion means may be embodied in many ways, one of which is illustrated in FIGS. 1 and 2 in the form of a weir plate 25 arranged between the first heat exchange surface 11 (e.g. provided on the tubes 12) and the open ends of the riser pieces 24. The illustrated weir plate 25 is arranged parallel to main axis A and inclined about 30° from the horizontal to guide the condensed heat transfer fluid 9 towards the longitudinal center of the box 13. Other arrangements are possible, such as a vertical arrangement of the weir plates whereby the first heat exchange surfaces are on one side of the vertical plane in which the weir plate is arranged, and the riser end pieces are on the other side of the vertical plane, and/or such as bubble caps on the riser end pieces similar to those used in distillation trays. Combinations of these and/or other ways may also be employed.

The specific ranges of angles of flow directions relative to the vertical as described above are particularly beneficial in case there may (occasionally) be two-phase flow through the downcomer 30. However, in addition to the preferred ranges of flow directions through the closed circuit as described above, other measures may optionally be implemented to reduce the probability that the downcomer 30 will have to support a two-phase flow as will be proposed below.

First, the downcomer 30 may be thermally insulated from the ambient 100. This is schematically shown in FIG. 1 by an insulation layer 35 applied to an external surface of the downcomer 30. The insulation layer 35 may be formed of and/or comprise any suitable pipe or duct insulating material and it may optionally be offering protection against under-insulation corrosion. Suitably the insulation layer comprises a foam material, preferably a closed-cell foam material to avoid percolation condense. One example is Armaflex™ pipe insulation optionally provided with an Armachek-R™ cladding, both commercially obtainable from Armacell UK Ltd. Armachek-R™ is a high-density rubber-based cover lining.

Second, the apparatus is preferably operated such that it comprises a liquid layer 6 of the heat transfer fluid 9 in the liquid phase accumulated within the first heat transfer zone 10. Only liquid from the liquid layer 6 is passed in liquid phase through the downcomer 30 to the second heat transfer zone 20.

Third, a vortex breaker 60 may be a provided at the upstream end of the downcomer 30, for instance at or near the interface between the first heat transfer zone 10 and the downcomer 30. In the embodiments of FIGS. 1 to 3, the vortex breaker 60 is suitably near the interface between the first heat transfer zone 10 and the common section 31 of the downcomer 30. A vortex breaker is a known device applied to avoid occurrence of a vortex swirl in the liquid layer 6, as this may entrap vapour in the liquid flowing into the downcomer 30.

Although not so indicated in FIGS. 1 to 3, the optional distribution header 40 may be thermally insulated from the ambient—for instance in the same way as the downcomer 30. The thermal insulation of the distribution header 40 may comprise a layer of an insulating material on the distribution header 40, preferably the same insulating material as used for the downcomer 30.

In operation, the apparatus according to any of the embodiments as described above is suitable for use in a method of heating a liquefied stream. A prime example of a liquefied stream to be heated is an LNG stream. The resulting heated stream may be a revaporized natural gas stream (produced by heating and vaporizing liquefied natural gas) may be distributed via a pipe network of a natural gas grid.

LNG is usually a mixture of primarily methane, together with a relatively low (e.g. less than 25 mol. %) amount of ethane, propane and butanes ($C_2$-$C_4$) with trace quantities of heavier hydrocarbons ($C_5$+) including pentanes and possibly some non-hydrocarbon components (typically less than 2 mol. %) including for instance nitrogen, water, carbon dioxide, and/or hydrogen disulfide. The temperature of LNG is low enough to keep it in liquid phase at a pressure of less than 2 bar absolute. Such a mixture can be derived from natural gas.

A suitable heat transfer fluid for accomplishing the heating of LNG is $CO_2$. The heat transfer fluid 9 is cycled in the closed circuit 5. During said cycling the heat transfer fluid 9 undergoes a first phase transition from vapour to liquid phase in the first heat transfer zone 10, and second phase transition from liquid to vapour phase in the second heat transfer zone 20.

According to a particularly preferred embodiment the heat transfer fluid comprises at least 90 mol % $CO_2$, more preferably it consists for 100 mol % or about 100 mol % of $CO_2$. An important advantage of $CO_2$ when used for heating LNG is that—if a leak occurs in the closed circuit 5 for the heat transfer fluid 9—the $CO_2$ will solidify at the leakage point thereby reducing or even blocking the leakage point. Moreover, $CO_2$ doesn't result in flammable mixtures if it would leak from the closed circuit. The boiling point of $CO_2$ is in the range of from −5.8 to −0.1° C. at pressures in the range of from 30 to 35 bar.

In the method of heating the liquefied stream, the liquefied stream that is to be heated is passed through the first heat transfer zone 10, in indirect heat exchanging contact with the heat transfer fluid 9, whereby heat is transferred from the heat transfer fluid 9 to the liquefied stream that passes through the first heat transfer zone 10. Thereby, at least part of the heat transfer fluid 9 is condensed to form a condensed portion. Preferably, the indirect heat exchanging takes place between the liquefied stream that is to be heated and the vapour of the heat transfer fluid 9 within the in the vapour zone 8.

Suitably, the liquefied stream that is to be heated is fed into one or more tubes 12 of the optional tube bundle 14. If the liquefied stream is at high pressure, it may be in a supercritical state wherein no phase transition takes place upon heating. Below the critical pressure, the liquefied stream may stay below its bubble point, or partially or fully vaporize in the one or more tubes 12, as it passes through the first heat transfer zone 10. The first heat exchange surface 11 is preferably arranged within the vapour zone 8 in the first heat transfer zone 10, above the nominal liquid level 7.

Preferably, the condensed portion of the heat transfer fluid 9 is allowed to accumulate in the first heat transfer zone 10 to form the liquid layer 6 of the heat transfer fluid 9 in the liquid phase. The condensed portion may drop from the first heat transfer surface 11, preferably above the nominal liquid level 7, into the liquid layer 6, possibly via the liquid diversion means such as one of the weir plates 25.

At the same time a part of the liquid heat exchange fluid 9 present in the liquid layer 6 flows into the downcomer 30. This forms part of the cycling of the heat transfer fluid 9 in the closed circuit 5. The liquid phase flows downward through the downcomer 30, and preferably thermally insulated from the ambient, from the first heat transfer zone 10 via the downcomer 30 to the second heat transfer zone 20, and back to the first heat transfer zone 20. The flow rate of the heat transfer fluid through the downcomer 30, or preferably the relative flow rates through each branch 32 of the downcomer 30, is regulated by the valve 33.

In the second heat transfer zone 20 the heat transfer fluid 9 is indirectly heat exchanging with the ambient, whereby heat is passed from the ambient to the heat transfer fluid 9 and the heat transfer fluid 9 is vaporized. The optional fan 50 may be utilized to increase circulation of ambient air along the second heat transfer zone 20. The ambient air may traverse the second heat transfer zone 20 in a downward direction, as indicated in FIG. 1 by the arrows 52.

The heat transfer fluid 9 preferably rises upward during said vaporizing of the heat transfer fluid 9 in the second heat transfer zone 20. This rising upward may take place in the at least one riser tube 22, preferably in the plurality of riser tubes 22. In the latter case, the condensed portion leaving the downcomer 30 is preferably distributed over the plurality of riser tubes 22.

Preferably no vapour is generated and/or present inside the downcomer 30, as any vapour in the downcomer 30 may adversely affect the flow behaviour of the heat transfer fluid 9 inside the closed circuit 5. Especially when the cycling of the heat transfer fluid 9 through the closed circuit 5 is exclusively driven by gravity, it is advantageous to avoid any vapour in the downcomer 30. During each single pass of said cycling of the heat transfer fluid 9 in the closed circuit 5 the condensed portion in liquid phase preferably passes from the first heat transfer zone 10 to the downcomer 30 via the vortex breaker 60, which further helps to avoid access of vapour into the downcomer 30.

The person skilled in the art will understand that the present invention can be carried out in many various ways without departing from the scope of the appended claims.

The invention claimed is:

1. An apparatus for heating a liquefied stream, comprising a closed circuit for cycling a heat transfer fluid, the closed circuit comprising a first heat transfer zone, a second heat transfer zone, and a downcomer, all arranged in ambient air, wherein the first heat transfer zone comprises a first box that contains the heat transfer fluid, which first box stretches longitudinally along a main axis, wherein a first heat transfer surface is arranged inside the first box, across which first heat transfer surface a first indirect heat exchanging contact is established between a liquefied stream that is to be heated and the heat transfer fluid, wherein the second heat transfer zone is located gravitationally lower than the first heat transfer zone and where the second heat transfer zone comprises a second heat transfer surface across which the heat transfer fluid is brought in a second indirect heat exchanging contact with the ambient air, and wherein the downcomer fluidly connects the first heat transfer zone with the second heat transfer zone, wherein the downcomer comprises a common section which fluidly connects the first heat transfer zone with a T-junction, where the heat transfer fluid is divided over two branches, wherein the branches of the downcomer comprise a first transverse portion and a first downward portion that are fluidly connected to each other via a connecting elbow portion, wherein the connecting elbow portion when viewed in a vertical projection on a horizontal plane is located external to the first box compared to the main axis.

2. The apparatus of claim 1, wherein the second heat transfer surface is arranged, at least for a part of the second heat transfer surface, in the space between the connecting elbow and the first box when seen in the projection on the horizontal plane.

3. The apparatus of claim 1, wherein a first nominal flow direction of the heat transfer fluid from the first heat transfer zone to the second heat transfer zone in the transverse portion of the downcomer is directed less vertical than a second nominal flow direction of the heat transfer fluid from the first heat transfer zone to the second heat transfer zone in the downward portion.

4. The apparatus of claim 3, wherein the second heat transfer zone comprises at least one riser tube that is fluidly connected to the first heat transfer zone, wherein the second heat transfer surface is located in a generally straight portion of the at least one riser tube, in which a third nominal flow direction of the heat transfer fluid deviates from vertical by an inclination angle that is less than the amount of deviation from the vertical of the first nominal flow direction and that is more than the amount of deviation from the vertical of the second nominal flow direction.

5. The apparatus of claim 4, wherein the third nominal flow direction deviates from vertical by an inclination angle of between 20° and 70°.

6. The apparatus of claim 4, wherein the third nominal flow direction deviates from vertical by an inclination angle of between 30° and 60°.

7. The apparatus of claim 3, wherein the first nominal flow direction, in the transverse portion of the downcomer, is deviated within a range of from 60° to 90° from the vertical direction.

8. The apparatus of claim 3, wherein the first nominal flow direction, in the transverse portion of the downcomer, is deviated within a range of from 80° to 90° from the vertical direction.

9. The apparatus of claim 3, wherein the second nominal flow direction, in the downward portion of the downcomer, is deviated within a range of from 0° to 40° from the vertical direction.

10. The apparatus of claim 3, wherein the second nominal flow direction, in the downward portion of the downcomer, is deviated within a range of from 0° to 30° from the vertical direction.

11. The apparatus claim 1, wherein the downcomer and the second heat transfer zone are fluidly connected with each other via a distribution header whereby the second heat transfer zone comprises a plurality of riser tubes fluidly connecting the distribution header with the first heat transfer zone wherein the riser tubes of the plurality of riser tubes are arranged distributed over the distribution header in a main direction that is parallel to the main axis.

12. The apparatus of claim 11, wherein the riser tubes are arranged over a two-dimensional pattern, both in the main direction and in a transverse direction extending transversely relative to the main direction.

13. The apparatus of claim 11, wherein, as seen in the main direction, a first subset consisting of at least one riser tube of the plurality of riser tubes is arranged on one side of the downcomer that connects the distribution header with the first heat transfer zone, and wherein a second subset consisting of at least one of the riser tubes of the plurality of riser tubes is arranged on the other side of the downcomer.

14. A method of heating a liquefied stream, comprising providing an apparatus according to claim 1, passing the liquefied stream that is to be heated through the first heat transfer zone of the apparatus, in indirect heat exchanging contact with the heat transfer fluid whereby heat transfers from the heat transfer fluid to the liquefied stream, thereby condensing at least part of the heat transfer fluid to form a condensed portion;

cycling the heat transfer fluid in the closed circuit from the first heat transfer zone via at least the downcomer to the second heat transfer zone and back to the first heat transfer zone, all arranged in an ambient, wherein said cycling of the heat transfer fluid comprises passing the condensed portion in liquid phase downward through the downcomer to the second heat transfer zone, and passing the heat transfer fluid through the second heat transfer zone to the first heat transfer zone, whereby in the second heat transfer zone indirectly heat exchanging with the ambient thereby passing heat from the ambient to the heat transfer fluid and vaporizing the heat transfer fluid.

15. The method according to claim 14, wherein the liquefied stream that is to be heated comprises liquefied natural gas and wherein a revaporized natural gas stream is produced by heating and thereby vaporizing said liquefied natural gas.

* * * * *